United States Patent [19]

Goldman et al.

[11] 4,150,345

[45] Apr. 17, 1979

[54] MICROSTRIP COUPLER HAVING INCREASED COUPLING AREA

[75] Inventors: Mark B. Goldman, Sudbury; Raymond C. Simione, Methuen, both of Mass.

[73] Assignee: Raytheon Company, Lexington, Mass.

[21] Appl. No.: 856,839

[22] Filed: Dec. 2, 1977

[51] Int. Cl.[2] ..... H01P 5/18

[52] U.S. Cl. ..... 333/116; 333/246

[58] Field of Search ..... 333/10, 84 M

[56] References Cited

U.S. PATENT DOCUMENTS

| | | | |
|---|---|---|---|
| 2,951,218 | 8/1960 | Arditi | 333/10 |
| 3,512,110 | 5/1970 | Clar | 333/10 |
| 3,681,713 | 8/1972 | Degenkolb et al. | 333/84 M |
| 3,798,575 | 3/1974 | DeBrecht et al. | 333/10 |

*Primary Examiner*—Paul L. Gensler

*Attorney, Agent, or Firm*—Richard M. Sharkansky; Joseph D. Pannone

[57] ABSTRACT

A microstrip coupler having a pair of conductive members electrically connected to the strip conductors of a pair of adjacent microstrip transmission lines and a dielectric element disposed between the walls of the conductive members. The height of the walls of the conductive members is significantly greater than the thickness of the strip conductors and therefore the electric field coupling region between the pair of strip conductors is increased from the relatively thin cross-sectional area of the strip conductors to a greater cross-sectional area provided by the walls of the conductive members. Because of this increase in electric field coupling area the effect of the dielectric material on the coupling factor between the microstrip transmission lines is significant to enable such coupler to provide coupling factors less than 6 db. Further, the coupling factor may be easily controlled by the dielectric constant of the dielectric material and the height of the walls of the conductive members.

8 Claims, 8 Drawing Figures

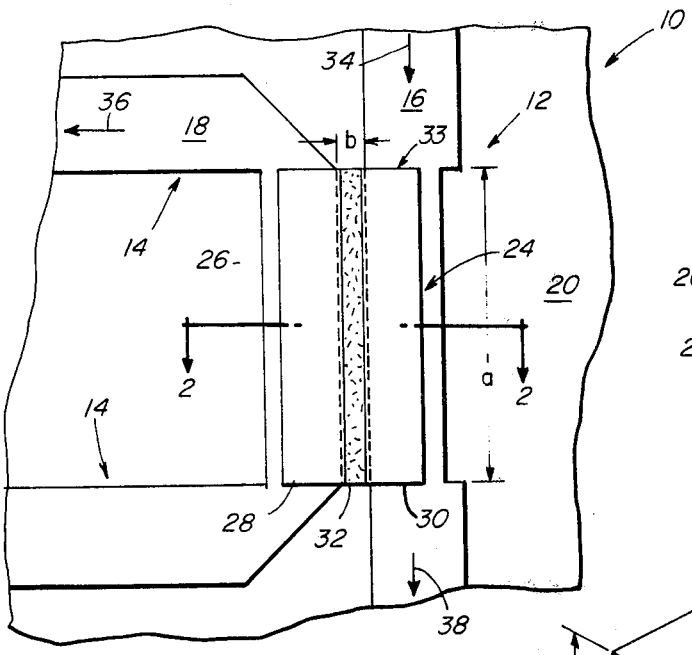
FIG. 1
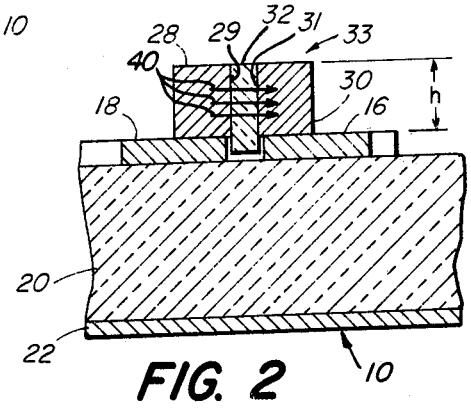
FIG. 2
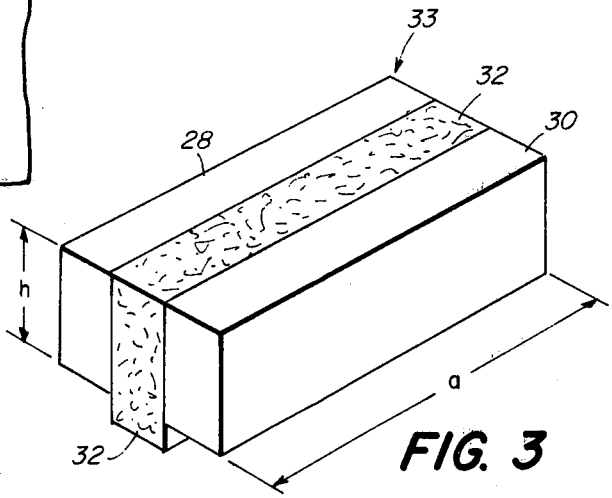
FIG. 3
FIG. 4
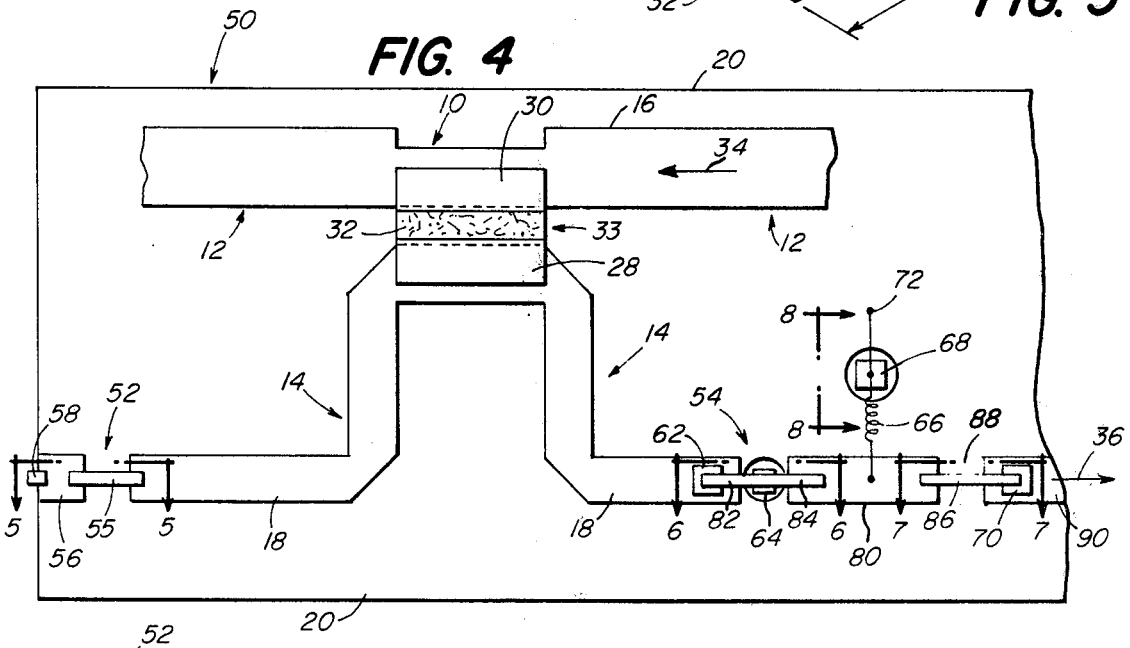
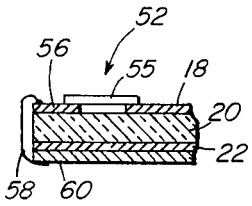
FIG. 5
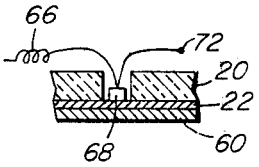
FIG. 8
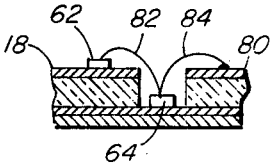
FIG. 6
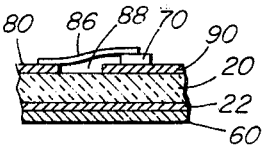
FIG. 7

MICROSTRIP COUPLER HAVING INCREASED COUPLING AREA

BACKGROUND OF THE INVENTION

This invention relates generally to microwave devices and more particularly to microstrip couplers.

As is known in the art, microstrip couplers generally include a pair of strip conductors formed on one surface of a dielectric support having a conductive ground plane formed on the opposite surface of such support, such strip conductors being disposed adjacent one another for an electrical length $\lambda_o/4$ where $\lambda_o$ is the mid-band operating wavelength of the coupler. The coupling factor of such coupler is related to the width of the gap separating the adjacent strip conductors and the impedances of the microstrip transmission lines formed with such strip conductors. The strip conductors are typically formed using photolithographic techniques. When such techniques are used to form such couplers, it is generally difficult to control the width of the gap between the strip conductors. For example, when such photolithographic process is used to form strip conductors of copper clad on a relatively soft dielectric support, the smallest controllable width of such gap is in the order of 1.5 mils. Therefore, using such conventional photolithographic techniques, the minimum coupling obtainable is approximately 8–10 db.

In order to achieve tighter coupling, say 3–6 db, more complex designs, such as interdigitated couplers and tandem couplers, are used in microstrip transmission line mediums or overlapping strip conductors in a stripline medium. The interdigitated coupler and tandem couplers are relatively large, require extremely tight tolerances on the photolithographic etching process, and must be fabricated on a dielectric support having a relatively high dielectric constant with a high quality surface finish. With regard to overlapping couplers formed in a stripline medium, many multifunction microwave circuits use a microstrip medium for switch, attenuator and phase shifter functions, and when a coupler having a coupling value of less than 10 db is required, the transition to a stripline medium is relatively costly and mechanically unreliable over a wide temperature range.

SUMMARY OF THE INVENTION

With this background of the invention in mind, it is, therefore, an object of this invention to provide an improved microstrip coupler.

This and other objects of the invention are attained generally by providing: A pair of adjacent strip conductors formed on one surface of a dielectric support having a conductive ground plane formed on a second surface of such support to form a pair of microstrip transmission lines, such pair of strip conductors being disposed parallel to each other for a length $\lambda_o/4$ where $\lambda_o$ is the nominal operating wavelength of the microstrip transmission lines in a coupling region; a pair of conductive members electrically connected to the pair of strip conductors having walls perpendicular to the dielectric support; and a dielectric element disposed between the walls of the pair of conductive members.

With such arrangement, the electric field coupling region between the pair of strip conductors is increased from the relatively thin cross-sectional area of the strip conductors to a greater cross-sectional area provided by the walls of the conductive members. Because of this increase in electric field coupling area, the effect of the dielectric material on the coupling factor is significant, and such coupling factor may be easily controlled by the dielectric constant of the dielectric material and the height of the walls of the conductive members.

BRIEF DESCRIPTION OF THE DRAWINGS

The above-mentioned and other features of the invention will become more apparent by reference to the following description taken together with the accompanying drawings, in which:

FIG. 1 is a plan view of a microwave coupler according to the invention;

FIG. 2 is a cross-sectional view of the microwave coupler of FIG. 1, such cross-section being taken along the line 2—2;

FIG. 3 is an isometric view of a coupling element used in the microwave coupler shown in FIG. 1;

FIG. 4 is a plan view, somewhat distorted, of a microwave circuit using a microwave coupler according to the invention; and FIGS. 5–8 are cross-sectional view, somewhat distorted, of portions of the microwave circuit shown in FIG. 4, such cross-sections being taken along lines 5—5, 6—6, 7—7 and 8—8, respectively.

DESCRIPTION OF THE PREFERRED EMBODIMENT

Referring now to FIGS. 1 and 2, a microwave coupler 10, here adapted to operate over the frequency band 7.6 GHz to 12.6 GHz, is shown to include a pair of microstrip transmission lines 12, 14. The pair of microstrip transmission lines 12, 14 includes a pair of strip conductors 16, 18 formed on one planar surface of a common dielectric substrate 20 and a conductive ground plane 22 formed on the opposite planar surface of such substrate 20. The strip conductors 16, 18 are disposed adjacent one another in a coupling region 24. The coupling region 24 extends for a length "a," here $\lambda_o/4$, where $\lambda_o$ is the nominal operating wavelength of the microwave coupler 10 in the dielectric medium (here $\lambda_o/4$ is 0.225 inches). In the coupling region 24 the strip conductors 16, 18 are parallel to each other and are separated from each other a length "b," here 0.0015 inches, in the coupling region 24. It is also noted that here the width of the strip conductors 16, 18 in the coupling region 24 is less than the width of the strip conductors 16, 18 outside of the coupling region 24 so that the characteristic impedance of the microstrip transmission lines 12, 14 in the coupling region 24 is greater than the characteristic impedance of the microstrip transmission lines 12, 14 outside the coupling region 24. The ratio of the characteristic impedance of the microstrip transmission lines 16, 18 in the coupling region 24 and the characteristic impedance of such lines 16, 18 outside of such region 24 is related to the coupling factor of the coupler 10. Here the characteristic even mode impedance of the microstrip transmission lines 16, 18 outside of the coupling region 24 is 50 ohms and the microstrip transmission lines 16, 18 in the coupling region 24 is in the order of 85 ohms.

The strip conductors 16, 18 and ground plane 22 are here copper clad on the dielectric substrate 20. The dielectric substrate 20 is here Duroid 5880 material having a dielectric constant of 2.2. The thickness of the dielectric substrate 20 is here 0.007 inches. The strip conductors 16, 18 are formed using conventional photolithographic etching techniques. The strip conductors have a width of here 0.012 inches in the coupling region 24 and a width of here 0.022 inches outside of the coupling region 24. Here strip conductor 18 is U-shaped, having parallel side arms perpendicular to the base 26 of the strip conductor 18. (It is noted that the base 26 of the strip conductor 18 is parallel to the strip conductor 16, and such base 26 is disposed in the coupling region 24. It is also noted that strip conductor 16 may, alternatively, be U-shaped, in which case the bases of both strip conductors would be parallel to each other and would be disposed in the coupling region.) The thickness of the strip conductors 16, 18 is here 0.0007 inches.

Microwave coupler 10 also includes a pair of conductive members 28, 30 electrically and mechanically connected to the portions of the strip conductors 16, 18 which are disposed in the coupling region 24. The conductive members 28, 30, here brass, are here soldered onto the strip conductors 16, 18 by solder, not shown. The conductive members 28, 30 have wall portions 29, 31 which are perpendicular to the planar surface of the dielectric substrate 20. Here the wall portions 29, 31 have a height, "h," here 0.005 inches, and a length which is equal to "a" of 0.225 inches. A dielectric element 32, here 0.0005 inch thick Teflon material, having a dielectric constant of 2.0, is forced or compressed between the wall portions 29, 31 of the conductive members 28, 30. It is noted that, to maximize the operating bandwidth of the microwave coupler 10, the dielectric constant of the dielectric element 32 and the dielectric constant of the dielectric substrate 20 are made nearly equal to each other. In this way the velocity of propagation of the microwave energy being coupled between the microstrip transmission lines 12, 14 (i.e., between the strip conductors 16, 18) is nearly equal to the velocity of propagation of the microwave energy passing through each of the microstrip transmission lines 12, 14 (i.e., between the strip conductors 16, 18 and the ground plane 22). That is, in the coupling region 24 the odd mode velocity of the microwave energy coupling between the microstrip transmission lines 12, 14 is nearly equal to the even mode velocity of such energy coupling into and out of the coupler 10 via each one of the microstrip transmission lines 12, 14. It is also noted that the width of the dielectric element 32 is generally slightly less than the separation between the strip conductors 16, 18 (i.e., the length "b") in the coupling region 24 so that the dielectric element 32 may be inserted into the space between the strip conductors 16, 18 as shown in FIG. 2.

The conductive members 28, 30 and the dielectric element 32 form a coupling element 33 as shown in FIG. 3. In operation, a portion of the microwave energy introduced into the microstrip transmission line 12, as indicated by arrow 34 (FIG. 1), is coupled to microstrip transmission line 18, as indicated by the arrow 36, and the remaining portion is transmitted through microstrip transmission line 12 as indicated by arrow 38 (FIG. 1). The effect of the wall portions 29, 31 is to increase the electric field coupling area between the strip conductors 16, 18 from the cross-sectional area of the strip conductors, i.e., the product of the thickness of such strip conductors and the length of the coupling region 24 to, in substance, the area of the wall portions 29, 31 (i.e., the product of the length, a, of such wall portions 29, 31 and the height, h, of such wall portions 29, 31). The electric field is indicated by arrows 40 in FIG. 2. It is noted that without the coupling element 33 the coupling between the microstrip transmission lines 12, 14 is approximately 10 db. However, with the coupling element 33 such coupling is 5.8 db at nominal operating frequency. It is also noted that the coupling element 33 has a minimal effect on changing the even mode impedance of the microstrip transmission lines 12, 14. The degree of coupling provided by the coupler 10 is in accordance with the dielectric constant of the dielectric element 32 and the height (h) of the wall portions 29, 31.

Referring now to FIG. 4, a microwave circuit 50 is shown to include a microwave coupler 10 used to couple 5.8 db of the radio frequency energy fed to microstrip transmission line 12 by a suitable source (not shown) to microstrip transmission line 14. Microstrip transmission line 14 is coupled to a suitable impedance matching microstrip load 52 and a microstrip PIN diode switching circuit 54, as shown. The impedance matching microstrip load 52 (and referring also to FIG. 5) includes a conventional resistor, here a so-called "chip" resistor 55, (here 50 ohms), having one electrode electrically connected to a strip conductor 18 of microstrip transmission line 14 in a conventional manner and another electrode electrically connected to a strip conductor 56, as shown. Strip conductor 56 is here gold plated copper clad on dielectric substrate 20. (In this regard it is noted that all strip conductors used in the microstrip circuit 50 are here gold plated in order to enable compression bonding to gold ribbons used in electrically connecting the various components using conventional bonding techniques.) Strip conductor 56 is electrically connected to the conductive housing 60 of the microwave circuit 50 using a gold ribbon 58. It is noted that the ground plane 22 is electrically connected to the conductive housing 60 in a conventional manner. Thus the gold ribbon 58 electrically connects the ground plane 22 and strip conductor 56 and passes over the edge of the dielectric substrate 20, as shown, to form a microstrip impedance matching load 52 in a conventional manner.

The microstrip PIN diode switching circuit 54 includes a metal oxide silicon (MOS) capacitor 62, a PIN diode 64, a coil 66, a ceramic "by-pass" capacitor 68 and a second MOS capacitor 70, all of conventional design and arranged in a conventional manner. Referring also to FIGS. 6, 7 and 8, MOS capacitor 62 is shown electrically connected to a strip conductor 18 of microstrip transmission line 14. PIN diode 64 is electrically connected to MOS capacitor 62 and strip conductor 80 using gold ribbons 82, 84 (and conventional bonding techniques), as shown. Also, coil 66 is shown connected to one electrode of the ceramic "by-pass" capacitor 68 in a conventional manner, a second electrode of such capacitor 68 being connected to a terminal 72, as shown. Coil 66 is electrically connected to strip conductor 80, as shown. Further, the MOS capacitor 70 is shown connected to strip conductor 80 with a gold ribbon 86 which passes over an air gap 88 formed between strip conductor 80 and strip conductor 90 in a conventional manner, as shown.

In operation, 5.8 db of the radio frequency fed to microstrip transmission line 12 from the source (not shown) along a direction indicated by arrow 34 is coupled to microstrip transmission line 14 and such coupled energy is adapted to be electrically coupled or decoupled out of such transmission line as indicated by arrow 36 selectively in accordance with a DC signal fed to terminal 72 from a suitable source (not shown).

It is noted that the microstrip impedance matching load 52 and microstrip PIN diode switching circuitry 54 are formed in a conventional manner; however, 5.8 db of the energy fed via a microstrip transmission line is fed to circuitry 54 by a coupler 10 formed with microstrip circuitry.

Having described a preferred embodiment of the invention, it is now evident that other embodiments incorporating its concepts may be used. For example, other frequency bands may be used with appropriate change in the dimensions of the microstrip transmission lines. Further, the use of other dielectric material for the dielectric element 32, such as alumina, quartz or sapphire, may be used to achieve different coupling values and to enable the coupler to operate over a greater bandwidth than that described. Still further, the dielectric element 32 may be formed with conductive walls which are bondable or solderable to the portions of the strip conductors in the coupling region thereby enabling accurate control on the fabrication of the coupling element. It is felt, therefore, that this invention should not be restricted to the above embodiment, but rather should be limited only by the spirit and scope of the appended claims.

What is claimed is:

1. A microstrip coupler for coupling microwave energy between a pair of adjacent microstrip transmission lines, such transmission lines having a ground plane formed on one surface of a dielectric substrate and a pair of strip conductors formed on the opposite surface of such substrate, such microstrip coupler comprising:

(a) a pair of conductive members, electrically connected to the pair of strip conductors, having wall portions of substantially greater height than the height of the strip conductors; and (b) a dielectric element disposed between the wall portions of the pair of conductive members.

2. The microstrip coupler recited in claim 1 wherein the dielectric constant of the dielectric element is substantially equal to the dielectric constant of the dielectric substrate.

3. The microstrip coupler recited in claim 2 wherein the length of the conductive members is $\lambda_o/4$ where $\lambda_o$ is the nominal operating wavelength of the coupler.

4. A microstrip device comprising:

(a) a pair of adjacent strip conductors formed on one surface of a dielectric support having a ground plane formed on a second surface of such support to form a pair of adjacent microstrip transmission lines;

(b) a microstrip coupler for coupling microwave energy between the strip conductors, comprising:

(i) a pair of conductive members, electrically connected to the pair of strip conductors, having wall portions substantially greater than the thickness of the strip conductors; and (ii) a dielectric element disposed between the wall portions of the pair of conductive members.

5. The microwave device recited in claim 4 wherein the dielectric constants of the dielectric element and the dielectric support are substantially equal.

6. The microwave device recited in claim 5 wherein the strip conductors are disposed parallel to each other for a length $\lambda_o/4$ where $\lambda_o$ is the nominal operating wavelength of the coupler.

7. The microwave device recited in claim 6 wherein the length of the coupler is $\lambda_o/4$.

8. The microwave device recited in claim 7 wherein the wall portions of the conductive members are perpendicular to the dielectric support.

* * * * *